United States Patent [19]

Tujimoto et al.

[11] 4,049,556

[45] Sept. 20, 1977

[54] FOAM FIRE EXTINGUISHING AGENT

[75] Inventors: Hiroaki Tujimoto, Osaka; Tatuya Maki, Nara; Sadao Suganuma, Tokyo; Taketora Sano, Kawasaki, all of Japan

[73] Assignees: Nippon Chemical Industrial Co., Ltd., Tokyo; Yamato Shokaki Co., Ltd., Osaka, both of Japan

[21] Appl. No.: 650,645

[22] Filed: Jan. 20, 1976

[51] Int. Cl.[2] ..... A62C 1/00

[52] U.S. Cl. ..... 252/3; 252/8.05; 252/356

[58] Field of Search ..... 252/8.05, 3, DIG. 7, 252/356

[56] References Cited

U.S. PATENT DOCUMENTS

| | | | |
|---|---|---|---|
| 3,258,423 | 6/1966 | Tuve et al. | 252/3 |
| 3,772,195 | 11/1973 | Francen | 252/3 |

FOREIGN PATENT DOCUMENTS

| | | | |
|---|---|---|---|
| 35,999 | 0000 | Japan | 252/3 |

*Primary Examiner*—Benjamin R. Padgett
*Assistant Examiner*—Josephine Lloyd
*Attorney, Agent, or Firm*—Sughrue, Rothwell, Mion, Zinn and Macpeak

[57] ABSTRACT

A foam fire extinguishing agent comprising (1) one or more alkyl acid phosphates and/or one or more salts thereof; (2) one or more amphoteric surface active agents; (3) one or more fluorocarbon-type surface active agents; and (4) an aqueous solution.

9 Claims, No Drawings

FOAM FIRE EXTINGUISHING AGENT

BACKGROUND OF THE INVENTION

1. Field of the Invention

This invention relates to a foam fire extinguishing agent, more specifically, to an improved foam fire extinguishing agent having superior fire extinguishing properties, which generates foams with improved resistance to heat and oils.

Description of the Prior Art

Heretofore, various fire extinguishing agents such as a foam fire extinguishing agent, a powder fire extinguishing agent, an evaporable liquid fire extinguishing agent or a gaseous fire extinguishing agent have been used for fire control. These fire extinguishing agents have both advantages and disadvantages. For example, there have been suggested a foamable fire extinguishing agent comprising a foamable substance and an alkyl acid phosphate and a salt thereof (Japanese patent publication No. 35999/70) and an aqueous film forming foam composition comprising a fluoroalkyl-containing water-soluble compound (Japanese patent publication No. 20080/65).

However, these conventional fire extinguishing agents are not entirely satisfactory, although they, in fact, possess fire extinguishing properties. For example, in the fire extinguishing agent of the first-mentioned Japanese Patent Publication, a known surface active agent is used as the foamable substance. Since this surfactant itself is not easily miscible with other materials, the addition of additives to improve water-retention properties, resistance saturation by oil, fire resistance and stability of the foams, such as urea, lauryl alcohol, or metal salts, which have poor solubility, results in unstable fire extinguishing agents. Furthermore, such fire extinguishing agents do not possess entirely satisfactory fire resistance, oil resistance and re-ignition prevention capability.

The composition disclosed in the latter-mentioned Japanese Patent Publication, on the other hand, will prevent re-ignition, but since it must be used in amounts of about 0.3 to 1% by weight to water, it is expensive to manufacture. Further, this foam composition has little capability to control fires on combustible liquids having a low ignition point.

SUMMARY OF THE INVENTION

Upon considering the present state of the art, we performed extensive research and found that a fire extinguishing agent comprising an alkyl acid phosphate, an amphoteric surface active agent and a fluorocarbon surface active agent has superior fire-extinguishing properties and is free from the defects of the conventional fire extinguishing agents described above while retaining all of the advantages thereof.

DESCRIPTION OF THE PREFERRED EMBODIMENTS

According to this invention, there is provided a foam fire extinguishing agent comprising, as essential ingredients, one or more alkyl acid phosphates and/or one or more salts thereof, one or more amphoteric surface active agents, and one or more fluorocarbon surface active agents (hereafter often referred to in the singular for purposes of brevity).

The alkyl acid phosphate used in this invention can be represented by the formulae:

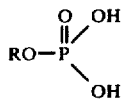

(I)

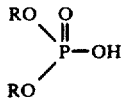

(II)

wherein R is an alkyl group containing 1 to 4 carbon atoms; an alkyl group substituted with an OH, halogen or $NH_2$ group; or a $(CH_2CH_2O)_nH$ or $(CH_2CH_2CH_2O)_nH$ group wherein $n$ is an integer of 2 to 4. Of the above, a mixture of a monoalkyl phosphate and a dialkyl phosphate in a proportion of about 1 : 1 is most preferred for use in this invention, since the reaction of the corresponding alcohol and phosphoric anhydride generally provides a mixture of a monoalkyl acid phosphate and a dialkyl acid phosphate in a proportion of about 1 : 1, i.e., the use of the above-described mixture is economically advantageous.

The alkyl acid phosphate is generally prepared from the corresponding alcohol and phosphoric anhydride, although other preparation methods can be used, if desired. It can be added to the foam fire extinguishing agent in the form of either formula (I) or formula (II) or as a mixture of compounds of formulae (I) and (II).

Useful salts of the phosphates include salts where all of the hydrogen atoms of the hydroxy group(s) in the alkyl acid phosphate are substituted, e.g., the ammonium salt, sodium salt, potassium salt, $(C_1-C_4)$alkylamine salts, or $(C_1-C_4)$alkanolamine salts. They can be used either alone or as a mixture of two or more thereof, and the degree of neutralization and substitution are not restricted. Of these, the ammonium salts are preferred.

Examples of alkyl acid phosphates or salts thereof are monomethyl acid phosphate, monoethyl acid phosphate, mono-n-propyl acid phosphate, monoisopropyl acid phosphate, mono-n-butyl acid phosphate, dimethyl acid phosphate, diethyl acid phosphate, di-n-propyl acid phosphate, diisopropyl acid phosphate, di-n-butyl acid phosphate, mono(chloroethyl) acid phosphate, bis(2,3-dibromopropyl) acid phosphate, bis(chloroethyl) acid phosphate, mono(2,3-dichloropropyl) acid phosphate, mono(monohydroxyethyl) acid phosphate, bis(monohydroxyethyl) acid phosphate, bis(monoaminobutyl) acid phosphate, and mono(monohydroxypropyl) acid phosphate; and their ammonium salts, sodium salts, potassium salts, monoethanolamine salts, diethanolamine salts, monomethylamine salts, diethylamine salts and diisopropylamine salts.

Of the above-described compounds, monoethyl acid phosphate, diethyl acid phosphate, mono(n- or iso-)propyl acid phosphate, di(n- or iso-)propyl acid phosphate and/or their $NH_4$ salts, $(C_1-C_4)$alkylamine salts, $(C_1-C_4)$alkanolamine salts, sodium salts and potassium salts are preferred in this invention, with monoethyl acid phosphate, diethyl acid phosphate, mono(n- or iso-)propyl acid phosphate, di(n- or iso-)propyl acid phosphate, and/or their $NH_4$ salts, monoethylamine salts, diethylamine salts, monoethanolamine salts, diethanolamine salts, triethanolamine salts, sodium salts and potassium salts being most preferred.

The amphoteric surface active agents used in this invention are surfactants which simultaneously exhibit the properties of any two of anionic, cationic and nonionic surfactants. For example, they can be a combination of an anionic and cationic surfactant, a combination of an anionic and nonionic surfactant, or a combination of a cationic and nonionic surfactant. Any commercially available amphoteric surface active agents can be used in this invention. For example, any carboxylic acid salt amphoteric surfactants including those of the amino acid type and betaine type, sulfate ester salt type amphoteric surfactants, sulfonic acid salt type amphoteric surfactants, and phosphate ester type amphoteric surfactants can be used in this invention. Of these, amino acid type and betaine type amphoteric surfactants wherein the hydrocarbon moiety thereof contains 5 to 18 carbon atoms are preferred. Most preferred amphoteric surfactants for use in the present invention are those represented by the formula:

$$R'-\underset{\underset{X'}{|}}{N}-CH_2CH_2COOM$$

wherein R' is an aliphatic hydrocarbon group containing 4 to 18 carbon atoms; X' is a hydrogen atom, an aliphatic hydrocarbon group containing 1 to 18 carbon atoms or a $CH_2CH_2COOM$ group; and M is a hydrogen atom, a sodium atom, a potassium atom, an $NH_4$ group, a $(C_1-C_6)$alkylamino group or a $(C_1-C_6)$alkanolamino group.

Specific examples of useful amphoteric surfactants are N-lauryl-N-myristyl-β-aminopropionic acid, N-lauryl-β-iminodipropionic acid, N-lauryl-N-methyl-β-aminopropionic acid, N-octyl-β-iminodipropionic acid, N-decyl-N-myristyl-β-aminopropionic acid, N-decyl-β-iminodipropionic acid, N-butyl-β-iminodipropionic acid, N-myristyl-β-iminodipropionic acid, N-stearyl-β-iminodipropionic acid, stearyl dimethyl betaine, lauryl dimethyl betaine, lauryl dihydroxyethyl betaine, lecithin, $C_8H_{17}NHCH_2CH(OH)CH_2OSO_3$, $C_{12}H_{25}CONHCH_2CH_2NHC_2H_4OSO_3$, $$\begin{array}{l} C_8H_{17}OOC-CH-NHC_2H_4SO_3, \\ \quad\quad\quad\;\; | \\ C_8H_{17}OOC-CH_2 \end{array}$$

$$C_8H_{17}CONHCH_2CH_2-O-P(=O)(O^{\ominus})(OCH_2CH_2N^{\oplus}H_3)$$

$$\begin{array}{l} C_8H_{17}COOCH_2 \\ \quad\quad\quad\quad\quad\quad\quad\quad O^{\ominus} \\ \quad\quad\quad\quad\quad\quad\quad\quad / \\ \quad\quad\quad\quad CHO-P=O \\ \quad\quad\quad\quad\quad\quad\quad\quad \backslash \\ C_8H_{17}COOCH_2 \quad\quad\quad\quad OCH_2CH_2N^{\oplus}(CH_3)_3 \end{array}, \text{ and}$$

$$C_{12}H_{25}O(CH_2CH_2O)_nSO_3^{\ominus};$$

and their sodium, potassium, ammonium, $(C_1-C_6)$alkylamine and $(C_1-C_6)$alkanolamine salts.

The fluorocarbon surface active agent used in this invention is available in various commercial grades. Of these, fluorocarbon surface active agents in which the fluorocarbon and fluorohydrocarbon moieties thereof have 6 to 10 carbon atoms, 13 to 21 fluorine atoms and 0 or 1 hydrogen atom are preferred for use in this invention. Fluorocarbon surface active agents in which the fluorocarbon and fluorohydrocarbon moieties thereof have 7 to 9 carbon atoms, 15 to 19 fluorine atoms and 0 or 1 hydrogen atom are most preferred. Especially suitable fluorocarbon surfactants are:

$(C_2F_5)_2(CF_3)C{\cdot}CH{=}C(CF_3)SO_3H$ $C_8F_{17}OC_6H_4SO_3Na$ $(C_2F_5)_2(CF_3)C{\cdot}CH{=}C(CF_3)SO_3NH_4$ $(C_2F_5)_2(CF_3)C{\cdot}CH{=}C(CF_3)SO_2Cl$ $(C_2F_5)_2(CF_3)C{\cdot}CH{=}C(CF_3)SO_2NH(CH_2)_3N(CH_3)_2$ $(C_2F_5)_2(CF_3)C{\cdot}CH{=}C(CF_3){\cdot}SO_2NH(CH_2)_3N(CH_3)_3{}^+I^-$ $(C_2F_5)_2(CF_3)C{\cdot}CH{=}C(CF_3)SO_2N(C_2H_5)_2$ $(C_2F_5)_2(CF_3)C{\cdot}CH{=}C(CF_3)SO_2N(C_2H_5)CH_2CH_2OCOCH{=}CH_2$ $[C_8F_{17}{\cdot}SO_2NH(CH_2)_3{\cdot}N(CH_3)_3]I$ $[C_7F_{15}{\cdot}CONH(CH_2)_3{\cdot}N(CH_3)_3]I$ $[C_7F_{15}\,.\,CONH(CH_2)_3\,.\,N(CH_3)_2CH_2CH_2OC(=O)\,.\,CH{=}CH_2]^{\oplus}Cl^{\ominus}$ $C_7F_{15}{\cdot}CONH(CH_2)_3{\cdot}N^+(CH_3)_2CH_2CH_2COO^-$ $C_8F_{17}SO_2N(C_2H_5)CH_2COOK$ $C_8F_{17}SO_2NHC_2H_5$ $C_8F_{17}SO_2N(C_2H_5)CH_2COOH$ $C_8F_{17}SO_2N(C_2H_5)(CH_2)_2OH$ $C_8F_{17}SO_2N(C_2H_5)SO_4Na$

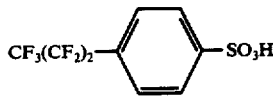

$CF_3(CF_2)_2PO(OH)_2$ $$\begin{array}{l} CF_3(CF_2)_7SO_2NCH_2COOH \\ \quad\quad\quad\quad\quad\quad\quad\quad | \\ \quad\quad\quad\quad\quad\quad\quad\quad C_2H_5 \end{array}$$

$CF_3(CF_2)_7SO_2N(CH_3)CH_2COOH$

These fluorocarbon surfactants can be used either alone or as a combination of two or more thereof.

The foam fire extinguishing agent of this invention can be prepared by dissolving the above-mentioned essential ingredients in an aqueous solvent such as water, brine, or an aqueous solution of a lower alcohol such as methanol, ethanol, ethylene glycol, etc. The proportions of the ingredients can be varied according, for example, to the types of the ingredients, the object of fire extinguishing, or whether the resulting extinguishing agent is a high concentration solution for storage or a dilute solution to be actually used for fire extinguishing, e.g., a dilute solution containing about 3 to about 20% by weight of one or more alkyl acid phosphates, about 0.1 to about 0.5% by weight of one or more amphoteric surfactants and about 0.01 to about 0.15% by weight of one or more fluorocarbon surfactants is a typical formulation actually used for fire extinguishing. Usually, the aqueous solution is prepared so that it contains about 0.3 to about 50% by weight of one or more alkyl acid phosphates and/or one or more salts thereof, about 0.05 to about 10% by weight of one or more amphoteric surfactants and about 0.001 to about 0.3% by weight of one or more fluorocarbon surfactants, balance aqueous solution.

When the amount of the alkyl acid phosphates and/or the salts thereof is higher than about 50% by weight, the viscosity of the resulting foam fire extinguishing agent rises, and also the foamability of the surface active agents is impeded. Thus, sufficient foaming cannot be attained, while cost is increased. On the other hand, when it is less than about 0.3% by weight, the resulting fire extinguishing agent has poor fire extinguishing capability, fire resistance and resistance saturation by oil in extinguishing fires on wooden materials (Class A fires) and oils (Class B fires).

When the amount of the amphoteric surfactant is higher than about 10% by weight, the foamability of the resulting fire extinguishing agent is reduced, and the fire resistance of the foams becomes inferior. When it is less than about 0.05% by weight, the foamability and drainage (a measure of the stability and water-retention property of the foams) of the fire extinguishing agent and the fire resistance of the foams are unsatisfactory.

When the fluorocarbon surfactant is used in an amount exceeding about 0.3% by weight, cost is excessively increased, and the fire resistance of the foams is rather reduced. When its amount is less than about 0.001% by weight, the resulting fire extinguishing agent is unsatisfactory in regard to fire resistance, resistance saturation by oil and re-ignition prevention of the foams.

The foam fire extinguishing agent of this invention is used in a conventional manner, i.e., after pressurizing air, carbon dioxide, gas, nitrogen, or another suitable non-combustible gas into or with the extinguishing agent. Actual fire extinguishing devices are well known in the art, and the method of utilizing the same is also well known; accordingly, no detailed explanation is believed necessary on this point. Typically, air aspirating foam-generating fire extinguishers utilize a pressurized gas such as air, carbon dioxide, nitrogen or the like, with conventionally used pressures for small fire extinguishers being about 8 to 10 kg/cm$^2$ and for large fire extinguishers being about 10 to 15 kg/cm$^2$. If desired, at least one other component, such as a foaming increasing agent, a resistance saturation by oil increasing agent, a solubilizing agent, a foam improver, or a freeze point lowering agent, can be added to the foam fire extinguishing agent of this invention.

The actions of the essential ingredients of the foam fire extinguishing agent will now be described. The alkyl acid phosphate or salt thereof has fire-extinguishing properties because it is a phosphorus-containing ester containing an organic group. When dissolved in water, it has a surface activating property, and together with the other surfactants contributes to the stability and resistance saturation by oil of the foams and reduces surface tension. Since it is also useful to impart flowability and good lubricity to solids or liquids, it also serves to improve the flowability of the foams. As it also has compatibility with organic substances, it contributes to the preparation of stable fire extinguishing agents and to improve the adhesion and penetration of the fire extinguishing agents to and into cellulosic substances. Furthermore, it has a freeze point lowering effect such that it finds utility as an antifreeze liquid. Thus, the alkyl acid phosphate is suitable for the preparation of foam fire extinguishing agents for use in cold climates.

The amphoteric surfactant, by a synergistic action with the alkyl acid phosphate or a salt thereof, provides foamability, stability and fire resistance to the foams even when used in extremely small amounts. Since the surfactant is amphoteric, it can be used together with any anionic, nonionic or cationic fluorocarbon surfactants.

The fluorocarbon-type surfactant, upon the formation of the foam for use, protects the foams from destruction by flames, and also increases the oil resistance of the foams, which in turn leads to an increase in the area over which the foams can spread.

Thus, according to the present invention, there are provided foam fire extinguishing agents having fire extinguishing properties, the capability to prevent re-ignition and good stability upon storage, both in ordinary and cold climates, which can be used against any type of fire (fires on wooden materials or on oils), which provide foams at the time of fire fighting which have superior flowability, fire resistance and oil resistance.

The following Examples, Comparative Examples and Test Examples illustrate the fire extinguishing agents of this invention in greater detail, wherein proportions are all expressed by weight, and unless otherwise specified, all ingredients are at 100% concentration.

Where no temperature of use is indicated, the fire extinguishing agents are for use at ordinary temperatures (−3° C to −5° C).

EXAMPLE 1

| | parts |
|---|---|
| Ammonium-neutralized salt of a 1 : 1 mixture of monoethyl acid phosphate and diethyl acid phosphate | 29.4 |
| Sodium-neutralized salt of N-lauryl-β-iminodipropionic acid | 0.27 |
| $C_8F_{17}OC_6H_4SO_3Na$ | 0.13 |
| Water | 70.2 |

The above ingredients were mixed to form a foam fire extinguishing agent which could be used even at −20° C.

EXAMPLE 2

| | parts |
|---|---|
| Potassium-neutralized salt of a 1 : 1 mixture of monoisopropyl acid phosphate and diisopropyl acid phosphate | 20.3 |
| Sodium-neutralized product of N-lauryl-N-methyl-β-aminopropionic acid | 0.3 |
| $C_7F_{15}CONH(CH_2)_3N^{\oplus}(CH_3)_2CH_2CH_2COO^{\ominus}$ | 0.13 |
| Water | 79.27 |

The resulting fire extinguishing agent could be used at −10° C.

EXAMPLE 3

| | parts |
|---|---|
| Sodium-neutralized product of 1 : 1 mixture of monomethyl acid phosphate and dimethyl acid phosphate | 12.5 |
| N-Stearyl-β-iminodipropionic acid | 0.4 |
| $C_8F_{17}OC_6H_4SO_3Na$ | 0.13 |
| Water | 86.97 |

EXAMPLE 4

| | parts |
|---|---|
| Diethanolamine-neutralized product of a 1 : 1 mixture of monoethyl acid phosphate and diethyl acid phosphate | 8.6 |
| Potassium-neutralized product of N-octyl-β-iminodipropionic acid | 0.7 |
| $C_8F_{17}SO_2N(C_2H_5)CH_2COOK$ | 0.15 |
| Water | 90.55 |

EXAMPLE 5

| | parts |
|---|---|
| Monoethanolamine-neutralized product of a 1 : 1 mixture of monobutyl acid phosphate and dibutyl acid phosphate | 14.2 |
| Sodium-neutralized product of N-lauryl-N-methyl-β-aminopropionic acid | 0.5 |
| $(C_2F_5)_2(CF_3)C \cdot CH{=}C(CF_3)SO_3NH_4$ | 0.14 |
| Water | 85.16 |

EXAMPLE 6

-continued

| | parts |
|---|---|
| Monoethylamine-neutralized product of monomethyl acid phosphate | 2.0 |
| Ammonium-neutralized product of monoethyl acid phosphate | 6.2 |
| Triethanolamine-neutralized product of N-lauryl-N-myristyl-β-aminopropionic acid | 0.2 |
| $C_7F_{15}CONH(CH_2)_3N^{\oplus}(CH_3)_2CH_2CH_2COO^{\ominus}$ | 0.13 |
| Brine (sea water) | 91.47 |

EXAMPLE 7

| | parts |
|---|---|
| 1 : 1 mixture of monobutyl acid phosphate and dibutyl acid phosphate | 3.0 |
| Ammonium-neutralized product of a 1 : 1 mixture of monoethyl acid phosphate and diethyl acid phosphate | 7.5 |
| Sodium-neutralized product of N-lauryl-β-iminodipropionic acid | 0.15 |
| $C_7F_{15}CONH(CH_2)_3N^{\oplus}(CH_3)_2CH_2CH_2COO^{\ominus}$ | 0.12 |
| Water | 89.23 |

EXAMPLE 8

| | parts |
|---|---|
| Sodium-neutralized product of a 1 : 1 mixture of monoisopropyl acid phosphate and diisopropyl acid phosphate | 5.0 |
| Ammonium-neutralized product of monomethyl acid phosphate | 3.0 |
| Monoethanolamine-neutralized product of N-butyl-β-iminodipropionic acid | 0.3 |
| $[C_8F_{17}SO_2NH(CH_2)_3\ mN(CH_3)_3]I$ | 0.11 |
| Water | 91.59 |

EXAMPLE 9

| | parts |
|---|---|
| Ammonium-neutralized product of diethyl acid phosphate | 5.0 |
| Sodium-neutralized product of a 1 : 1 mixture of monoisopropyl acid phosphate and diisopropyl acid phosphate | 3.0 |
| Sodium-neutralized product of N-octyl-β-iminodipropionic acid | 0.2 |
| $C_8F_{17}OC_6H_4SO_3Na$ | 0.09 |
| Water | 91.71 |

EXAMPLE 10

| | parts |
|---|---|
| Ammonium-neutralized product (70% aqueous solution) of a 1 : 1 mixture of monoethyl acid phosphate and diethyl acid phosphate | 7.4 |
| Sodium-neutralized product (30% aqueous solution) of N-lauryl-β-iminodipropionic acid | 0.3 |
| $C_8F_{17}SO_2N(C_2H_5)CH_2COOK$ | 0.13 |
| Water to make | 100 |

EXAMPLE 11

| | parts |
|---|---|
| Ammonium-neutralized product (70% aqueous solution) of a 1 : 1 mixture of monoethyl acid phosphate and diethyl acid phosphate | 15.0 |
| Sodium-neutralized product of N-lauryl-β-iminodipropionic acid (30% aqueous solution) | 0.35 |
| Ethylene glycol | 8.0 |
| $C_7F_{15}CONH(CH_2)_3N^{\oplus}(CH_3)_2CH_2CH_2COO^{\ominus}$ | 0.1 |
| $C_8F_{17}SO_2N(C_2H_5)CH_2COOK$ | 0.03 |
| Water to make | 100 |

The resulting fire extinguishing agent could be used at −10° C.

EXAMPLE 12

| | parts |
|---|---|
| Ammonium-neutralized product (70% aqueous solution) of a 1 : 1 mixture of monoethyl acid phosphate and diethyl acid phosphate | 10.4 |
| Lauryl dihydroxyethyl betaine | 0.13 |
| Ethylene glycol | 1.0 |
| $C_8F_{17}OC_6H_4SO_3Na$ | 0.13 |
| Water to make | 100 |

EXAMPLE 13

| | parts |
|---|---|
| Ammonium-neutralized product of mono(chloroethyl) acid phosphate | 8.4 |
| Lecithin | 0.12 |
| Ethylene glycol | 1.0 |
| $C_7F_{15}CONH(CH_2)_3N^{\oplus}(CH_3)_2CH_2CH_2COO^{\ominus}$ | 0.12 |
| Water to make | 100 |

-continued

EXAMPLE 14

| | parts |
|---|---|
| Sodium-neutralized product of bis(2,3-dibromopropyl) acid phosphate | 3.3 |
| Potassium-neutralized product of a 1 : 1 mixture of monoethyl acid phosphate and diethyl acid phosphate | 5.0 |
| Sodium-neutralized product of N-lauryl-β-iminodipropionic acid | 0.15 |
| Ethylene glycol | 8.0 |
| $[C_8F_{17}SO_2NH(CH_2)_3N(CH_3)_3]I$ | 0.11 |
| Water to make | 100 |

EXAMPLE 15

| | parts |
|---|---|
| Monoethanolamine-neutralized product of mono(chloroethyl) acid phosphate | 10.0 |
| $C_8H_{17}CONHCH_2CH_2O-P(=O)(O-Na)(OCH_2CH_2N^{\oplus}H_3)$ | 0.20 |
| $[C_8F_{17}SO_2NH(CH_2)_3N(CH_3)_3]I$ | 0.11 |
| Water to make | 100 |

EXAMPLE 16

| | parts |
|---|---|
| Diethanolamine-neutralized product of mono(aminoethyl) acid phosphate | 2.0 |
| Triethanolamine-neutralized product of diethyl acid phosphate | 11.0 |
| $C_{12}H_{25}CONHCH_2CH_2NHC_2H_4OSO_3$ (sodium-neutralized) | 0.3 |
| Ethylene glycol | 1.0 |
| $C_8F_{17}OC_6H_4SO_3Na$ | 0.15 |
| Water to make | 100 |

EXAMPLE 17

| | parts |
|---|---|
| Ammonium-neutralized product of a 1 : 1 mixture of mono(hydroxyethyl) acid phosphate and bis(hydroxyethyl) acid phosphate | 5.0 |
| Diethanolamine-neutralized product of mono(hydroxyethoxyethyl) acid phosphate | 5.0 |
| $C_8H_{17}OOC-CH(C_8H_{17}OOC-CH_2)-NHC_2H_4SO_3$ | 0.3 |
| $C_8F_{17}OC_6H_4SO_3Na$ | 0.13 |
| Water to make | 100 |

COMPARATIVE EXAMPLE 1

(corresponding to Example 1)

| | parts |
|---|---|
| Ammonium-neutralized salt of a 1 : 1 mixture of monoethyl acid phosphate and diethyl acid phosphate | 29.4 |
| Sodium-neutralized salt of N-lauryl-β iminodipropionic acid | 0.27 |
| Water | 70.33 |

The above ingredients were mixed to form a fire extinguishing agent which could be used at −20° C.

COMPARATIVE EXAMPLE 2

(corresponding to Example 2)

| | parts |
|---|---|
| Potassium-neutralized product of a 1 : 1 mixture of monoisopropyl acid phosphate and diisopropyl acid phosphate | 20.3 |
| Sodium-neutralized product of N-lauryl-N-methyl-β-aminopropionic acid | 0.3 |
| Water to make | 100 |

COMPARATIVE EXAMPLE 3

(corresponding to Example 10)

| | parts |
|---|---|
| Ammonium-neutralized product (70% aqueous solution) of a 1 : 1 mixture of monoethyl acid phosphate and diethyl acid phosphate | 7.4 |
| Sodium-neutralized product of N-lauryl-β-iminodipropionic acid (30% aqueous solution) | 0.3 |
| Water to make | 100 |

COMPARATIVE EXAMPLE 4

(corresponding to Example 11)

| | parts |
|---|---|
| Ammonium-neutralized product of a 1 : 1 mixture of monoethyl acid phosphate and diethyl acid phosphate | 15.0 |
| Sodium-neutralized product (30% aqueous solution) of N-lauryl-β-iminodipropionic acid | 0.35 |

-continued

| | |
|---|---|
| Ethylene glycol | 8.0 |
| Water to make | 100 |

COMPARATIVE EXAMPLE 5

| | parts |
|---|---|
| Light water* (FC-200) | 6 |
| Water | 94 |

COMPARATIVE EXAMPLE 6

| | parts |
|---|---|
| Light water (FC-200) | 6 |
| Ethylene glycol | 24.2 |
| Water | 69.8 |

*Light water is a registered trademark of the Minnesota Mining and Manufacturing Company, and is an aqueous film-forming fire extinguishing agent mainly composed of a fluorocarbon surface active agent, which does not contain any phosphorus compound and is a conventional foam fire extinguishing agent.

This fire extinguishing agent could be used at −10° C.

In the following Test Examples, the fire extinguishing agents were applied in a conventional manner, i.e., air or a gas, for example, $CO_2$, $N_2$, etc., was used to pressurize the fire extinguishers and aspirating air was used to generate foams. Since this aspect of the present invention is conventional, and the amount of air or gas used is not directly related to the proportions of the fire extinguishing compositions of the present invention, suffice it to say that application was by conventional techniques.

TEST EXAMPLE 1

6 liters of each of the foam fire-extinguishing agents obtained in Examples 1 to 17 and Comparative Examples 1 to 6 was placed in a fire extinguisher, and subjected to a fire extinguishing test (A-1 to A-5 units of general wooden material fire) as provided in Article 3 of the Ministerial Ordinance Stipulating Technical Standards of Fire Extinguishers, Japan, 1973". The results were as follows:

| | | | |
|---|---|---|---|
| Example | 1 | A-5 | completely extinguished |
| | 2 | A-4 | " |
| | 3 | A-3 | " |
| | 4 | A-3 | " |
| | 5 | A-4 | " |
| | 6 | A-3 | " |
| | 7 | A-3 | " |
| | 8 | A-3 | " |
| | 9 | A-3 | " |
| | 10 | A-3 | " |
| | 11 | A-4 | " |
| | 12 | A-3 | " |
| | 13 | " | " |
| | 14 | " | " |
| | 15 | " | " |
| | 16 | " | " |
| | 17 | " | " |
| Comparative Example | 1 | A-5 | " |
| | 2 | A-4 | " |
| | 3 | A-3 | " |
| | 4 | A-4 | " |
| | 5 | A-1 | " |
| | 6 | A-1 | There is no fire extinguishing ability since refiring occurred after 1.5 minutes (re-ignition). |

The A fire units show the fire extinguishing capability of a fire-extinguishing material as set down in Article 3 of the "Ministerial Ordinance Stipulating Technical Standards of Fire Extinguishers, Japan, 1973". For example, A-1 represents the capability to completely extinguish fire on one "second model" (90 dry cedar bricks; 35 mm × 35 mm × 730 mm; hereinafter merely referred to as a "second model"), A-2 represents the capability to completely extinguish fire on one "first model" (144 dry cedar bricks; 35 mm × 35 mm × 900 mm; hereinafter merely referred to as a "first model"), A-3 represents the capability to extinguish fire on one first model as defined above and one second model, A-4 denotes the ability to extinguish fire on two first models, and A-5 denotes the ability to extinguish fire on two first models and one second model.

TEST EXAMPLE 2

Similarly, a test for extinguishing fire on oils was carried out using gasoline. It was found that all of the fire-extinguishing agents obtained in Examples 1 to 17 and Comparative Examples 1 to 6 could completely extinguish a fire on a B-12 unit.

A re-ignition test (like Burn back test in U.S.A.) using a lighted gasoline torch was passed over the foam surface 3, 5 and 10 minutes, respectively, after the fire was extinguished. The gasoline did not ignite in the case of the fire extinguishing agents of Examples 1 to 17. Even after 30 minutes, the foams covered the gasoline surface, and the gasoline could not be ignited.

On the other hand, in the case of Comparative Examples 1 to 4, the gasoline was ignited by the torch 3 minutes after fire extinguishing, and the fire spread over the complete surface of the gasoline. After 3 minute's ignition test, all of the test samples were ignited, and the fire spread all over.

The B fire units show the fire extinguishing capability stipulated in "Ministerial Ordinance Stipulating Technical Standards of Fire Extinguishers, Japan, 1973". For example, B-12 units define the fire extinguishing capability when 72 liters of gasoline is placed in a square ignition container with 155 cm sides, ignited, and extinguished one minute later.

TEST EXAMPLE 3 (like burn back test in U.S.A.)

6 liters of each of the foam extinguishing agents obtained in Examples 1 to 17 and Comparative Examples 1 to 6 was placed in a fire extinguisher after adjusting its temperature to 20° C. Then, a fire extinguishing test (B-12 units) of an oil fire model (surface area 2.4 $m^2$) was conducted. One minute after the completion of fire extinguishing, an oil surface with an area of 250 $cm^2$ was exposed at the center of the oil, and the center re-ignited. The increase in area of the burning area as compared to the original 250 $cm^2$ area after 3 minutes was measured. The results were as follows:

| | | |
|---|---|---|
| Example | 1 | 10 times |
| | 2 | 5 times |
| | 3 | 7 times |
| | 4 | 2 times |
| | 5 | 10 times |
| | 6 | 3 times |
| | 7 | 5 times |
| | 8 | spontaneously extinguished after 1.5 minutes |
| | 9 | 3 times |
| | 10 | spontaneously extinguished after 1 minute |
| | 11 | 3 times |
| | 12 | 10 times |
| | 13 | 3 times |
| | 14 | 3 times |
| | 15 | 7 times |
| | 16 | 5 times |
| | 17 | 7 times |
| Comparative Example | 1 | spread over complete surface in 40 seconds |
| | 2 | spread over complete surface in 1 minute |
| | 3 | spread over complete surface in 1 minute |
| | 4 | spread over complete surface in 30 seconds |
| | 5 | spontaneously extinguished after 1 minute |
| | 6 | spread 10 times 1.5 minutes later |

TEST EXAMPLE 4

The same test procedures as were used in Test Examples 2 and 3 were carried out using white gasoline (made by Esso Co.) which contained higher amounts of low boiling point fractions as compared with the gasoline used in Test Examples 2 and 3 (which was automobile gasoline made by Nippon Oil Co., Ltd.). The results obtained are given below.

| | | |
|---|---|---|
| Example | 6 | 5 times |
| | 7 | 10 times |
| | 8 | 4 times |
| | 9 | 7 times |
| | 10 | 3 times |
| | 11 | 10 times |
| Comparative Example | 5 | spread 10 times 2.5 minutes later |
| | 6 | spread 10 times 30 seconds later |

The fractions of the automobile gasoline (made by Nippon Oil Co., Ltd.) and the white gasoline (made by Esso Co.) used are given below.

| Boiling Point | <36° C | 37-80° C | 81-139° C | >140° C | Total |
|---|---|---|---|---|---|
| Gasoline* (wt%) | 39.0 | 33.6 | 19.1 | 8.3 | 100 |
| White Gasoline** (wt%) | 43.0 | 51.8 | 5.2 | 0 | 100 |

*Made by Nippon Oil Co., Ltd.
**Made by Esso Co.

As is clear from the test results, the present invention is superior to the prior art with respect to fire resistance and re-ignition capability, and the fire extinguishing agents of this invention are especially superior in fire extinguishing properties and fire resistance after extinguishing.

While the invention has been described in detail and with reference to specific embodiments thereof, it will be apparent to one skilled in the art that various changes and modifications can be made therein without departing from the spirit and scope thereof.

What is claimed is:

1. A foam fire extinguishing agent comprising about 0.3 to about 50% by weight of one or more alkyl acid phosphates and/or one or more salts thereof, about 0.05 to about 10% by weight of one or more amphoteric surface active agents, about 0.001 to 0.3% by weight of one or more fluorocarbon-type surface active agents, and as the balance of said agent an aqueous solution, said one or more amphoteric surfactants being selected from the group consisting of compounds represented by the formula:

$$R'-\underset{\underset{X'}{|}}{N}-CH_2CH_2COOM.$$

wherein R' is an aliphatic hydrocarbon group containing 4 to 18 carbon atoms; X' is a hydrogen atom, an aliphatic hydrocarbon group containing 1 to 18 carbon atoms or a $CH_2CH_2COOM$ group; and M is a hydrogen atom, a sodium atom, a potassium atom, an $NH_4$ group, a $(C_1-C_6)$alkylamino group or a $(C_1-C_6)$alkanolamino group; and said one or more fluorocarbon-type surfactants being selected from the group consisting of $C_8F_{17}-OC_6H_4SO_3Na$, $C_8F_{17}SO_2N(C_2H_5)CH_2COOK$, $(C_2F_5)_2(CF_3)C{\cdot}CH{=}C(CF_3)SO_3NH_4$ and $[C_8F_{17}-SO_2NH(CH_2)_3{\cdot}N(CH_3)_3]I$.

2. The foam fire extinguishing agent of claim 1, wherein said alkyl acid phosphates are represented by the formulae:

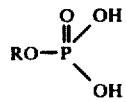

(I)

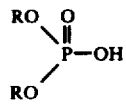

(II)

wherein R is an alkyl group containing 1 to 4 carbon atoms; such as alkyl group substituted with an OH, halogen or $NH_2$ group; or a $(CH_2CH_2O)_nH$ or $(CH_2CH_2CH_2O)_nH$ group, wherein $n$ is an integer of 2 to 4.

3. The foam fire extinguishing agent of claim 2, wherein the monoalkyl phosphate and the dialkyl phosphate are used in a proportion of about 1 to 1.

4. The foam fire extinguishing agent of claim 2, wherein said alkyl acid phosphates and/or one or more salts thereof are selected from the group consisting of monoethyl acid phosphate, diethyl acid phosphate, mono(n- or iso-)propyl acid phosphate, di(n- or iso-)propyl acid phosphate and/or their $NH_4$ salts, $(C_1-C_4)$alkylamine salts, $(C_1-C_4)$alkanolamine salts, sodium salts, and potassium salts.

5. The foam fire extinguishing agent of claim 1, wherein said one or more amphoteric surfactants is selected from the group consisting of N-lauryl- N-myristyl- β-aminopropionic acid, N-lauryl-β-iminodipropionic acid, N-lauryl-N-methyl-β-aminopropionic acid, N-octyl-β-iminodipropionic acid, N-decyl-N-myristyl-β-aminopropionic acid, N-decyl-β-iminodipropionic acid, N-butyl-β-iminodipropionic acid, N-myristyl-β-iminodipropionic acid, N-stearyl-β-iminodipropionic acid, and their sodium, potassium, ammonium, $(C_1-C_6)$alkylamine and $(C_1-C_6)$alkanolamine salts.

6. The foam fire extinguishing agent of claim 1, which comprises about 5 to about 30% by weight of one or more of said alkyl acid phosphates and/or one or more of said salts thereof, about 0.1 to about 0.7% by weight of one or more of said amphoteric surfactants, and about 0.05 to about 0.2% by weight of one or more of said fluorocarbon surfactants.

7. The foam fire extinguishing agent as claimed in claim 1, further comprising one or more non-combustible gases.

8. The foam fire extinguishing agent of claim 7, wherein said one or more non-combustible gases are selected from the group consisting of air, $CO_2$, and $N_2$.

9. The foam fire extinguishing agent as claimed in claim 1, wherein said aqueous solution is water, sea water or a mixture of water and a lower alcohol.

* * * * *